US005101651A

United States Patent [19]

Yeomans

[11] Patent Number: 5,101,651

[45] Date of Patent: Apr. 7, 1992

[54] APPARATUS FOR DETERMINING THE FORCE IMPOSED ON A TERMINAL DURING CRIMPING THEREOF

[75] Inventor: Michael A. Yeomans, Camp Hill, Pa.

[73] Assignee: AMP Incorporated, Harrisburg, Pa.

[21] Appl. No.: 660,191

[22] Filed: Feb. 22, 1991

[51] Int. Cl.[5] ..... B21B 37/08; B21B 37/00

[52] U.S. Cl. ..... 72/19; 72/474; 72/412; 29/753

[58] Field of Search ..... 72/19, 416, 474, 470, 72/412, 478, 465, 21; 29/863, 753; 384/42, 908

[56] References Cited

U.S. PATENT DOCUMENTS

| | | | |
|---|---|---|---|
| 2,479,653 | 8/1949 | Walter | 384/42 |
| 3,184,950 | 5/1965 | Sitz | 72/331 |
| 3,427,839 | 2/1969 | Neumann | 72/21 |
| 3,564,883 | 2/1971 | Koors et al. | 72/19 |
| 4,019,362 | 4/1977 | McKeever | 29/753 |
| 4,148,203 | 4/1979 | Farazandeh et al. | 72/21 |
| 4,442,691 | 4/1984 | Grow et al. | 72/465 |
| 4,856,186 | 8/1989 | Yeomans | 29/863 |
| 4,916,810 | 4/1990 | Yeomans | 29/863 |
| 4,972,764 | 11/1990 | Ohya et al. | 384/908 |

FOREIGN PATENT DOCUMENTS

| | | | |
|---|---|---|---|
| 0184204 | 6/1980 | European Pat. Off. | 29/753 |
| 0034518 | 2/1989 | Japan | 72/19 |

*Primary Examiner*—Lowell A. Larson
*Assistant Examiner*—Michael J. McKeon
*Attorney, Agent, or Firm*—James M. Trygg

[57] ABSTRACT

The present invention is directed to the determination of the force imposed on a terminal being crimped onto a wire. The crimping mechanism includes a cantilevered member which is deflected an amount that is proportional to the crimping force imposed on the terminal by the crimping bar. The amount of this deflection is sensed by four strain gages which are coupled to the cantilevered member and are electrically interconnected to form a Wheatstone bridge. The output of the Wheatstone bridge is then translated into actual force being imposed upon the terminal.

10 Claims, 3 Drawing Sheets

APPARATUS FOR DETERMINING THE FORCE IMPOSED ON A TERMINAL DURING CRIMPING THEREOF

This invention relates to the crimping of terminals onto wires and particularly to determining the force imposed on the terminal during the crimping cycle.

BACKGROUND OF THE INVENTION

Terminals are typically crimped onto wires by means of a terminal applicator which is operated by a conventional press. Such a press and applicator arrangement is disclosed in U.S. Pat. No. 3,184,950 which issued May 25, 1965 to Sitz and is incorporated herein by reference. Such applicators include two crimping die sets, one for crimping the terminal onto the conductor of the wire and the other for crimping the strain relief portions of the terminal onto the insulated portion of the wire. Each crimping die set includes a crimping bar, or punch, and a mating anvil. The anvils are usually fixed stationary with respect to the base of the press while the crimping bars are carried by and reciprocate with the ram into and out of crimping engagement with their respective anvils. This type applicator has no provisions for sensing and measuring the force imposed on a terminal during the crimping cycle. U.S. Pat. No. 4,856,186, on the other hand, which issued Aug. 15, 1989 to Yeomans and is incorporated herein by reference, shows a crimping press that utilizes a strain gage attached to the crimping anvil to sense the force imposed on the terminal. Since crimping presses and terminal applicators are arranged to accept a variety of different crimping die sets, with this arrangement a strain gage must necessarily be attached to each anvil. This, of course, is an added expense and requires the reconnection of the electrical connections every time the die set is changed. Efforts were made to locate a strain gage within the base of the applicator, however, these efforts were not successful due to the lack of room under the anvils and the difficulty in separating the wire crimping force from the insulation crimping force.

The present invention provides the desired sensor and means for measuring the force imposed on the terminal by the crimping of the terminal onto the wire conductor exclusive of the insulation crimping force, while permitting the exchange of die sets without the need to reconnect the sensor element.

SUMMARY OF THE INVENTION

The present invention provides a means for determining the force imposed on a terminal being crimped onto a conductor of a wire. A terminal applicator is provided having a base and a ram arranged for opposed relative reciprocating motion, and a crimping die set. The anvil of the die set is attached to the base while the crimping bar of the die set is coupled to the ram by a coupling means including a cantilevered member projecting from the ram and a fastener means for securing the crimping bar to the ram. The crimping bar has a major surface that is urged against a mounting surface of the ram with a force of about 1000 pounds and an abutting surface in abutting engagement with the cantilevered member, so that during the crimping cycle a substantial amount of the force imposed on the terminal due only to the crimping of the terminal onto the conductor is transmitted through the crimping bar to the cantilevered member. A measuring means is provided for measuring the force imposed on the cantilevered member and a means is provided for translating that measured force to an actual force imposed on the terminal.

DESCRIPTION OF THE PREFERRED EMBODIMENT

Figure 1:
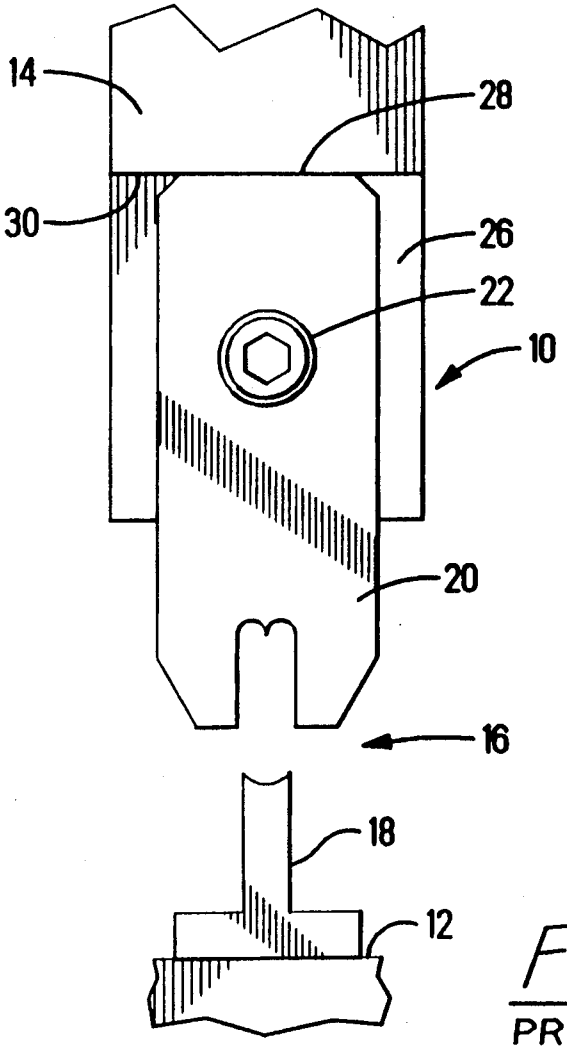
FIG. 1 PRIOR ART
FIGS. 1 and 2 are front and side views respectively of a portion of a prior art terminal applicator showing how the crimping bar is secured to the ram.
Figure 2:
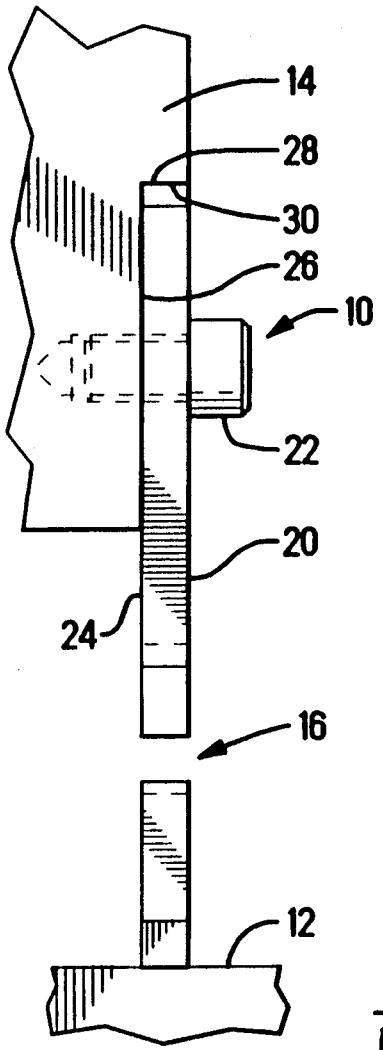
FIG. 2 PRIOR ART

FIGS. 1 and 2 illustrate a portion of a typical prior art terminal applicator 10 of the type disclosed in the above referenced '950 patent. The applicator 10 includes a base 12 and a ram 14 arranged for reciprocating motion toward and away from the base 12. A die set 16 for crimping a terminal onto the conductor of a wire is shown. The die set 16 includes an anvil 18 which is secured to the base 12 by suitable screw fasteners, not shown, and a crimping bar, or punch 20, which is secured to the ram 14 by means of a screw fastener 22 which is threaded into a hole in the ram 14. The crimping bar 20 has a major surface 24 which is urged tightly against a mounting surface 26 of the ram 14 by the screw fastener 22. The crimping bar 20 also has an abutting surface 28 which is in abutting engagement with a shoulder 30 disposed in the ram 14. During the crimping cycle, the force imposed on the terminal by the mating of the crimping bar 20 with the anvil 18 is transmitted downwardly through the anvil 18 to the base 12 and upwardly through the crimping bar 20 to both the shoulder 30 and to the mounting surface 26 by virtue of the screw 22. The screw 22 is usually tightened to about 70 inch pounds of torque resulting in a clamping force of about 2000 pounds against the mounting surface 26 resulting in some of the upwardly transmitted force being diverted from the crimping bar 20 to the mounting surface 26. This clamping force inhibits sideways movement of the crimping bar 20 during operation. It will be understood that this is a somewhat simplified view of a prior art terminal applicator in that many parts have been omitted such as the insulation crimping die set as well as the shut height adjusting mechanism and the part feeding mechanism. However, the present disclosure is directed to the measurement of the force imposed on the terminal when crimping the terminal onto a conductor of a wire and, therefore, will be limited to structure directed only to that end. If desired, the above referenced '950 patent will provide a detailed explanation of such a terminal applicator.

Figure 3:
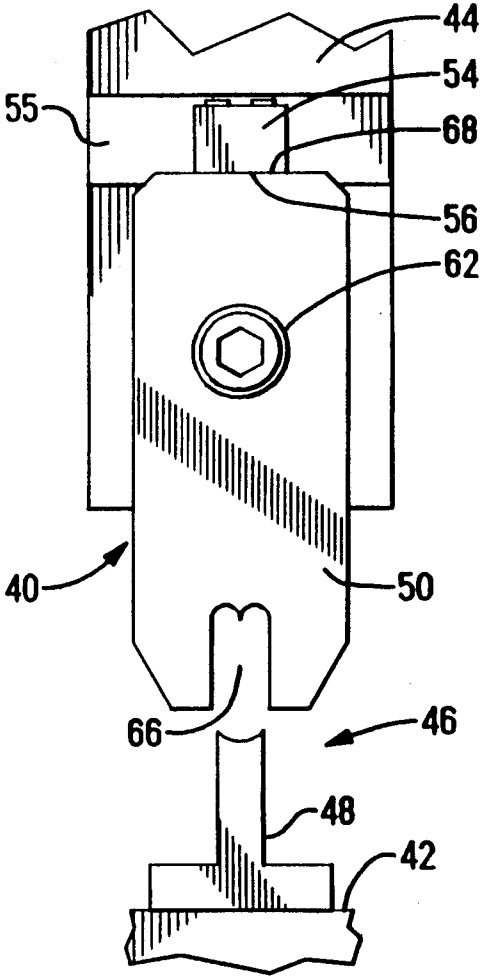
FIGS. 3 and 4 are front and side views respectively of a portion of a terminal applicator showing how the crimping bar is secured to the ram in accordance with the teachings of the present invention.
Figure 4:
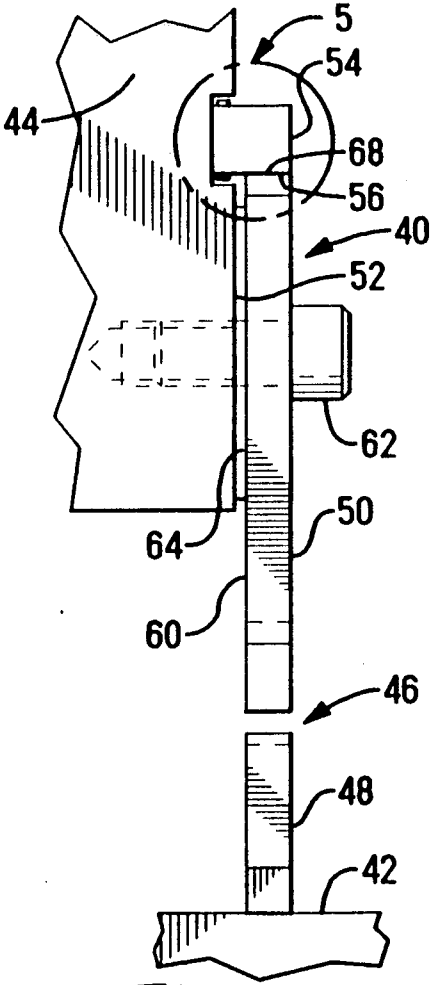

FIGS. 3 and 4 illustrate a portion of a terminal applicator 40 similar to that disclosed in FIGS. 1 and 2, however, showing how the crimping bar is coupled to the ram in accordance with the teachings of the present invention. The applicator 40 includes a base 42 and a ram 44 arranged for reciprocating motion toward and away from the base 42 in a manner similar to that of the prior art applicator 10. A die set 46 for crimping a terminal onto a conductor of a wire is shown. The die set 46 includes an anvil 48 which is secured to the base 42 by any suitable means, and a crimping bar, or punch 50 which is secured to the ram 44. The ram 44 includes a mounting surface 52 and a cantilevered member 54 projecting outwardly from the mounting surface as shown in FIGS. 3 and 4. An undercut 55 is provided in the surface 52 around the cantilevered member 54 for a purpose that will be set forth below. The cantilevered member 54 includes a banking surface 56 which is substantially normal to the mounting surface 52.

The crimping bar 50, having a major surface 60, is secured to the ram 44 by means of the screw 62. The screw 62 is tightened to about 70 inch pounds of torque resulting in a clamping pressure of about 2000 pounds urging the major surface 60 toward the mounting surface 52. In the present example, a layer 64 of material is disposed intermediate the major surface 60 and the mounting surface 52 for a purpose that will be explained below. The crimping bar 50 has a die opening 66 at one end thereof for mating with the anvil 48. An abutting surface is disposed at the opposite end of the crimping bar 50 and is in abutting engagement with the banking surface 56 of the cantilevered member as shown in FIGS. 3 and 4.

Figure 5:
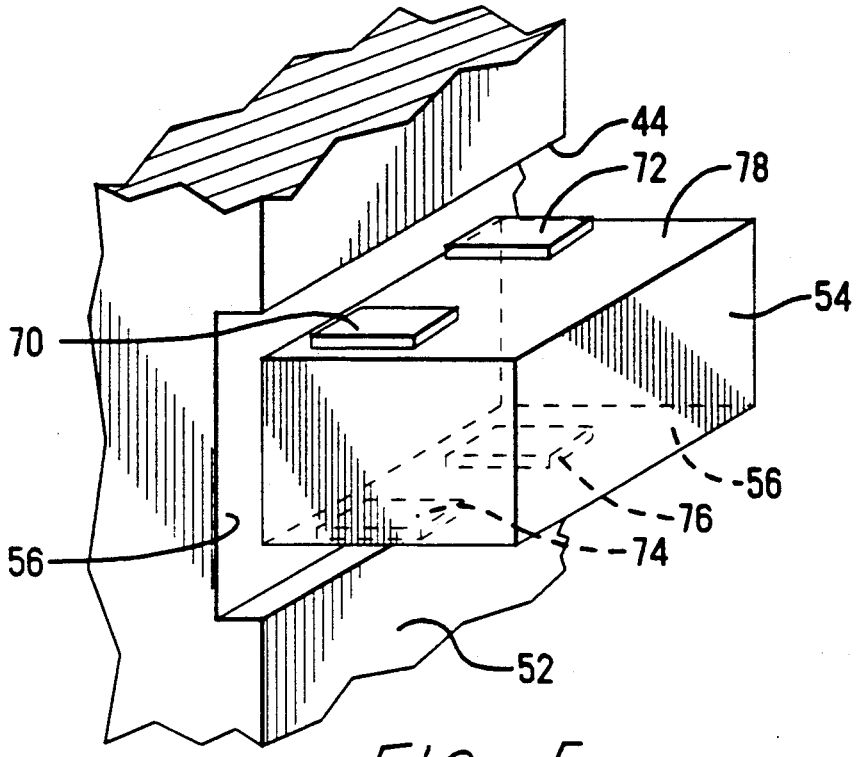
FIG. 5 is an isometric enlarged view of the portion of FIG. 4 indicated by the arrow 5.

The cantilevered member 54 and ram 44 are of unitary construction, being machined from a single piece of material. Four strain gages 70,72,74 and 76 are attached to the cantilevered member in the usual manner, with the gages 70 and 72 being positioned on a surface 78 which is opposite the banking surface 56, and the gages 74 and 76 being positioned on the banking surface 56, as best seen in FIG. 5. In the present example, strain gage model number TK-06-S085N-350 was used which is manufactured by Measurements Group Inc. of Raleigh, N.C. However, any suitable strain gage may be advantageously used in the practice of the present invention.

Figure 6:
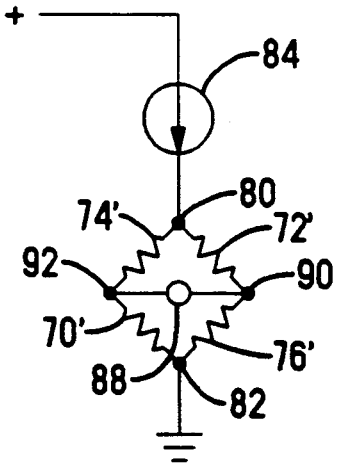
FIG. 6 is a schematic diagram showing the electrical interconnections of the strain gages of FIG. 5.

There is shown in FIG. 6 a schematic diagram of the electrical hook up of the four strain gages 70,72,74 and 76 which are identified as 70',72',74' and 76' respectively. Note that the four strain gages are interconnected in the form of a Wheatstone bridge with its nodes 80 and 82 connected to a constant current source 84 and ground respectively. This provides a regulated current through the Wheatstone bridge in the usual manner. A voltage monitoring device 88 is connected to the nodes 90 and 92 for sensing voltage changes in the circuit. The monitoring device 88, in the present example, includes an analog to digital convertor and a computer interconnected in a manner similar to that shown in U.S. Pat. No. 4,916,810 which issued Apr. 17, 1990 to Yeomans and which is incorporated herein by reference.

In operation, a terminal and associated wire, not shown, are positioned on the anvil 48, see FIGS. 3 and 4, and the ram 44 is made to reciprocate downwardly toward the base 42. As the crimping bar 50 engages the terminal, the resistance of the terminal results in a force being upwardly directed through the crimping bar 50 causing the abutting surface 68 to push against the banking surface 56 of the cantilevered member 54. This causes the cantilevered member 54 to deflect upwardly, as viewed in FIG. 4, an amount that is approximately proportional to the force being imposed upon the terminal being crimped. The undercut 55 enhances deflection by moving the root of the cantilevered member 54 further away from the banking surface 56, as viewed in FIG. 4. This upward deflection of the cantilevered member 54 causes the strain gages 70 and 72 to undergo a slight compression and the other strain gages 74 and 76 to undergo a slight tension. This in turn causes an imbalance in the Wheatstone bridge circuit resulting in a change in voltage at the nodes 90 and 92 which is proportional to the force being imposed upon the cantilevered member and is indicative of the force being imposed upon the terminal being crimped. This resulting changed voltage is monitored by the device 88 and is translated into the actual force imposed on the terminal in a manner set forth in the above referenced '810 patent. Or, if desired, any suitable means that is known in the industry may be utilized to perform the translation.

In order for the cantilevered member to be deflected, as described above, the abutting surface 68 of the crimping bar 50 must necessarily move upwardly a finite amount in response to the crimping operation. However, as was set forth above, the crimping bar 50 is clamped to the ram 44 with a force of about 2000 pounds to provide lateral stability to the crimping bar during production crimping. This clamping force causes some of the crimping force being directed upwardly through the crimping bar to be diffused into the ram 44 so that the resulting force that deflects the cantilevered member is not identical to the force imposed upon the terminal being crimped. Further, the difference between these two forces is affected by the condition of the surfaces 60 and 52 and the presence of foreign matter. To minimize this difference and to provide a high degree of repeatability, the layer 64 was sandwiched between the two surfaces 60 and 52. The layer 64 may be any material that has a modulus of elasticity sufficient so that it can withstand the 2000 pound clamping force and has a coefficient of friction with steel of about 0.1 or less. It was found that a layer 64 of oil was simply squeezed out by the clamping pressure, however, a layer of polytetrafluoroethylene having a coefficient of friction of about 0.04 or less, commonly known as TEFLON, was found to be quite satisfactory. While the teachings of the present invention may be advantageously employed without the inclusion of the layer 64, its inclusion renders the system more sensitive and responsive to small changes in the force imposed on the terminal by the crimping bar 50. Additionally, the layer 64 has sufficient compressive strength to permit the clamping of the crimping bar 50 to the ram 44 to assure lateral stability of the crimping bar during sustained operation in a production environment.

Figure 7:
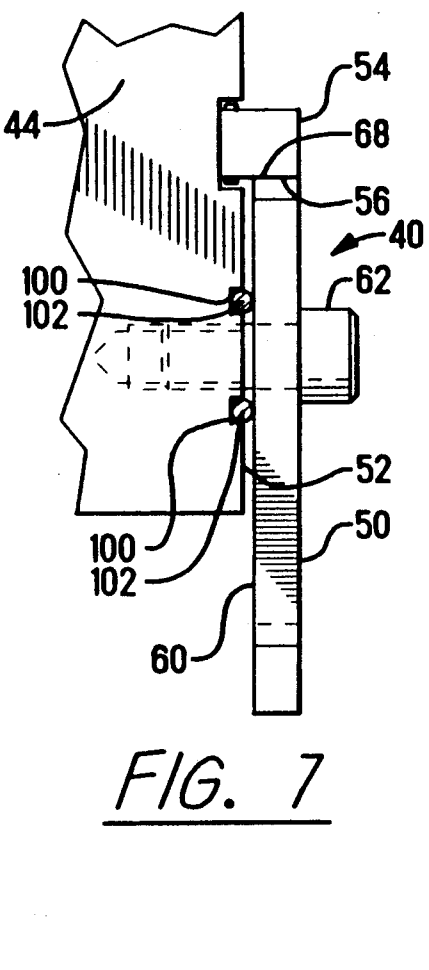
FIG. 7 is a view similar to that of FIG. 4 showing a second embodiment of the invention.

A variation in the terminal applicator 40 is shown in FIG. 7 which is somewhat similar to FIG. 4 having like elements commonly identified. As shown in FIG. 7, the layer 64 is replaced with a pair of slots 100 which are disposed in the mounting surface 52 and run transversely across its face, a slot 100 being on each side of the screw 62. A pair of rollers 102 are disposed, one in each slot as shown in FIG. 7. The slots 100 have a depth slightly less than the diameter of the rollers and a width slightly greater than the diameter thereby permitting a slight rolling action in the vertical direction as viewed in FIG. 7. With this structure, the screw 62 may be tightened to the desired value to provide the necessary lateral stability of the crimping bar 50 while, at the same time, providing for slight vertical movement of the crimping bar to deflect the cantilevered member as set forth above. With this structure, any desired number of slots 100 and rollers 102 may be utilized and the slots 100 may be disposed in either the mounting surface 52 or the major surface 60. Additionally, the slots 100 and rollers 102 may be replaced with openings containing balls or other rolling members, the openings being of any suitable shape.

An important advantage of the present invention is that the force imposed on a terminal being crimped may be determined easily and accurately while maintaining lateral stability of the crimping bar. This is accomplished without the added expense of installing strain gages on each different crimping anvil and the need for reconnecting electrical connections when the crimping die sets ar changed.

I claim:

1. In a terminal applicator for crimping a terminal onto a conductor of a wire by means of a crimping die set, said applicator having a base and a ram arranged for opposed relative reciprocating motion, said ram carrying a crimping bar of said crimping die set and said base carrying an anvil of said crimping die set, said crimping bar having a major surface and an adjacent abutting surface, means for determining the force imposed on said terminal caused only by the crimping of said terminal onto said conductor comprising:

(a) coupling means for coupling said crimping bar to said ram, said coupling means including:

(1) a cantilevered member projecting from said ram;

(2) fastener means for securing said crimping bar to said ram so that said major surface of said crimping bar is urged toward a mounting surface of said ram with a force sufficient to assure lateral stability of said crimping bar with respect to said ram, and said abutting surface is in abutting engagement with said cantilevered member;

so that during said crimping of said terminal, a substantial amount of said force imposed on said terminal is transmitted through said crimping bar to said cantilevered member;

(b) measuring means for measuring the amount of force imposed on said cantilevered member during said crimping of said terminal; and (c) means for translating said measured force into said force imposed on said terminal.

2. The applicator according to claim 1 wherein said measuring means includes at least one strain gage associated with said cantilevered member.

3. The applicator according to claim 1 wherein said measuring means includes a pair of strain gages arranged to sense compression of said cantilevered member and a pair of strain gages arranged to sense tension of said cantilevered member during said crimping of said terminal, said two pairs of strain gages electrically interconnected to form a Wheatstone bridge.

4. The applicator according to claim 3 wherein said cantilevered member projects from said mounting surface of said ram, and said mounting surface is undercut in the proximate area substantially surrounding said cantilevered member.

5. The applicator according to claim 1 including a layer of material having a surface coefficient of friction of about 0.04 or less, said layer being disposed between said major surface and said mounting surface.

6. The applicator according to claim 5 wherein said layer of material comprises a layer of polytetrafluoroethylene (TEFLON).

7. The applicator according to claim 6 wherein said layer of TEFLON is deposited on one of said major surface or said mounting surface.

8. The applicator according to claim 6 wherein said layer of TEFLON is separate from said major surface and said mounting surface wherein said layer of TEFLON engages said major surface of said crimping bar and said mounting surface of said ram and has a coefficient of friction of about 0.04 or less at the points of said engagement.

9. The applicator according to claim 1 including:

(a) at least two openings formed in either said major surface or said mounting surface straddling said fastener means;

(b) a rolling member having a specific diameter in each of said openings, wherein the depth of each of said openings is less than said specific diameter and the width of each of said openings is greater than said specific diameter.

10. The applicator according to claim 9 wherein said openings are slots and said rolling members are rollers.

* * * * *